US006286804B1

(12) United States Patent
Avinger et al.

(10) Patent No.: US 6,286,804 B1
(45) Date of Patent: Sep. 11, 2001

(54) MOLDED PENTAGONAL TREE STAND

(75) Inventors: Andrew G. Avinger; Stephen L. Fillipp, both of Lubbock, TX (US)

(73) Assignee: Gary Products Group, Inc., Lubbock, TX (US)

( * ) Notice: Subject to any disclaimer, the term of this patent is extended or adjusted under 35 U.S.C. 154(b) by 0 days.

(21) Appl. No.: 09/571,839

(22) Filed: May 16, 2000

Related U.S. Application Data

(63) Continuation-in-part of application No. 29/107,000, filed on Jun. 24, 1999, now Pat. No. Des. 424,969.

(51) Int. Cl.[7] ..... F16M 13/00

(52) U.S. Cl. ..... 248/523; 248/519; 248/521; 47/40.5

(58) Field of Search ..... 248/519, 527, 248/523, 521, 524; 47/40.5; D11/130.1

(56) References Cited

U.S. PATENT DOCUMENTS

| | | | | |
|---|---|---|---|---|
| D. 188,862 | * | 9/1960 | Krastel | D11/130.1 |
| D. 269,571 | * | 7/1983 | Geshwind | D6/105 |
| D. 299,217 | * | 1/1989 | Schoenborn | D11/130.1 |
| D. 351,570 | | 10/1994 | Fillipp | D11/130.1 |
| D. 364,831 | | 12/1995 | Fillipp | D11/130.1 |
| D. 382,227 | | 8/1997 | Adams et al. | D11/130.1 |
| 558,433 | * | 4/1896 | Stoddard | 248/519 |
| 1,742,212 | * | 1/1930 | Muldoon | D11/130.1 |
| 2,733,032 | * | 1/1956 | Farley et al. | 248/519 |
| 5,725,193 | | 3/1998 | Adams | 248/523 |
| 5,743,508 | | 4/1998 | Fiveash | 248/527 |
| 5,845,890 | | 12/1998 | Earsley et al. | 248/516 |

* cited by examiner

*Primary Examiner*—Ramon O. Ramirez
*Assistant Examiner*—Kimberly Wood
(74) *Attorney, Agent, or Firm*—Locke Liddell & Sapp LLP; Monty L. Ross

(57) ABSTRACT

A tree stand having a unitarily molded plastic body having a pentagonal reservoir with a downwardly curved buttress extending radially outward on each side of the reservoir to a peripherally extending base flange defining inwardly curving arcs between adjacent buttresses, upwardly directed retaining walls disposed along said arcs between said buttresses; and a bolt receptacle elevated above the reservoir at the top of each buttress.

8 Claims, 3 Drawing Sheets

MOLDED PENTAGONAL TREE STAND

CROSS-REFERENCE TO RELATED APPLICATIONS

This application is a continuation in part of U.S. application Ser. No. 29/107,000, filed Jun. 24, 1999, issued May 16, 2000 as U.S. Pat. No. Des. 424,969.

BACKGROUND

1. Technical Field

This invention relates to molded stands suitable for use in supporting the trunk of a decorative tree, and more particularly, to a molded plastic tree stand having a unitarily molded body with a pentagonal recess in which the tree is supported that can serve as a water reservoir for live trees.

2. Related Prior Art

Plastic tree stands are well known, having previously been disclosed, for example, in U.S. Pat. Nos. Des. 351,570, Des. 364,831, Des. 368,674 and the references cited therein. A molded tree having an oversize reservoir with side wall sections projecting into the reservoir is disclosed in U.S. Pat. No. 5,743,508. U.S. Pat. No. 5,725,193 discloses a tree stand comprising a generally cylindrical, cup-shaped container having five detachable, radially extending legs and an optional connecting ring to improve stability of the stand. Three locations are provided for the insertion of bolts useful for securing the tree inside the stand. U.S. Pat. No. Des. 382,227 discloses another tree stand comprising a cylindrical container with five detachable legs without an optional connecting ring. Five locations are provided around the top rim of the container for the insertion of tree attachment bolts, with each location being aligned with one of the radially extending legs.

A unitarily molded plastic tree stand is needed that has a stable and compact footprint; that is sturdy; that has a large reservoir opening in combination with relatively smooth inside walls to receive and support a natural tree having a large or irregular trunk diameter; that has sufficient reservoir volume to accommodate a significant quantity of water, even when a large diameter trunk is inserted into the reservoir; and that has more than three bolt-receiving positions useful for securely attaching the stand to the tree.

SUMMARY OF THE INVENTION

The tree stand disclosed herein comprises a unitarily molded plastic body having a reservoir with a pentagonal cross-section, a top rim, smooth side walls slightly tapered downwardly and inwardly from the top rim to a bottom; a downwardly curved buttress extending radially outward on each side of the reservoir to a peripherally extending base flange defining inwardly curving arcs between adjacent buttresses; upwardly directed retaining walls disposed along said arcs; and a bolt receptacle elevated above the top rim at the top of each buttress.

According to a particularly preferred embodiment of the invention, the inwardly directed surfaces of each bolt receptacle are substantially continuous with the inside surface of the adjacent side wall of the pentagonal reservoir. Concave recesses are desirably molded into the top of each buttress radially outward of the bolt receptacles to provide relief for the head of a rotatable bolt insertable through apertures provided in the bolt receptacles. Concave recesses are also desirably provided at the base of each buttress to facilitate insertion of anchor screws downwardly through flange apertures vertically aligned with the recesses.

Each corner of the pentagonal top rim extends radially outward beyond an imaginary line connecting the inwardly facing midpoint of the bolt receptacle to the bolt receptacle of the next adjacent side in each direction around the pentagonal reservoir. A plurality of unitarily molded reinforcing ribs are desirably provided beneath the upwardly facing surfaces of the tree stand, including the bottom of the pentagonal reservoir, to provide additional structural reinforcement to the stand.

BRIEF DESCRIPTION OF THE DRAWINGS

The apparatus of the invention is further described and explained in relation to the following figures of the drawings in which.

DESCRIPTION OF THE PREFERRED EMBODIMENTS

Figure 1:
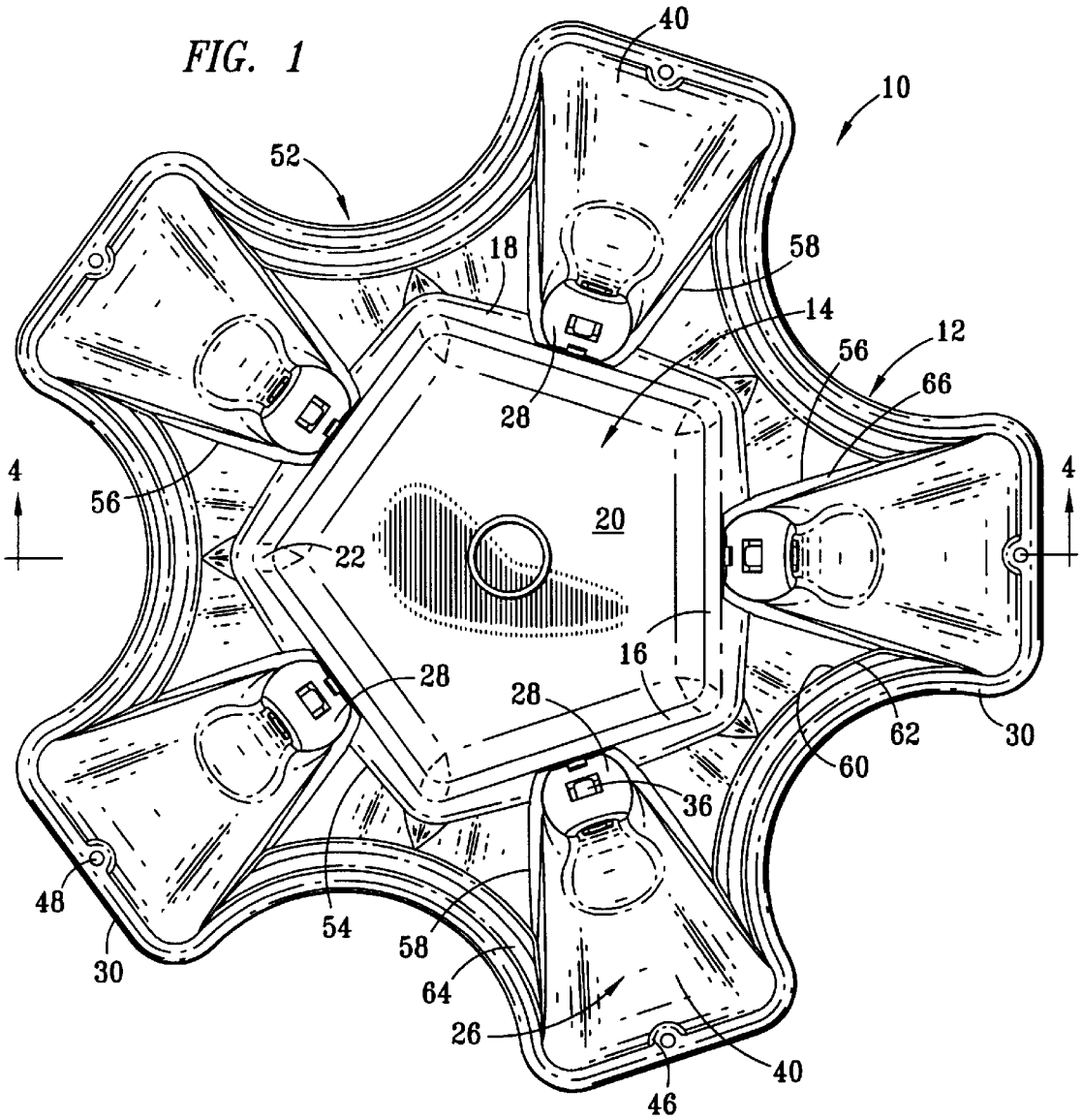
FIG. 1 is a top plan view of a preferred embodiment of the molded tree stand of the invention.
Figure 2:
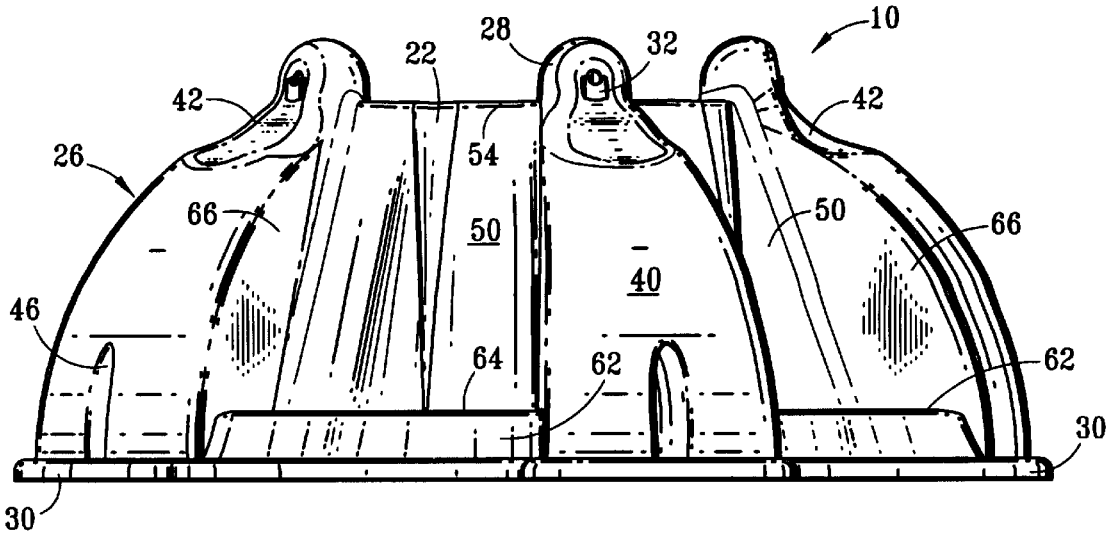
FIG. 2 is a front elevation view of the tree stand of FIG. 1.
Figure 3:
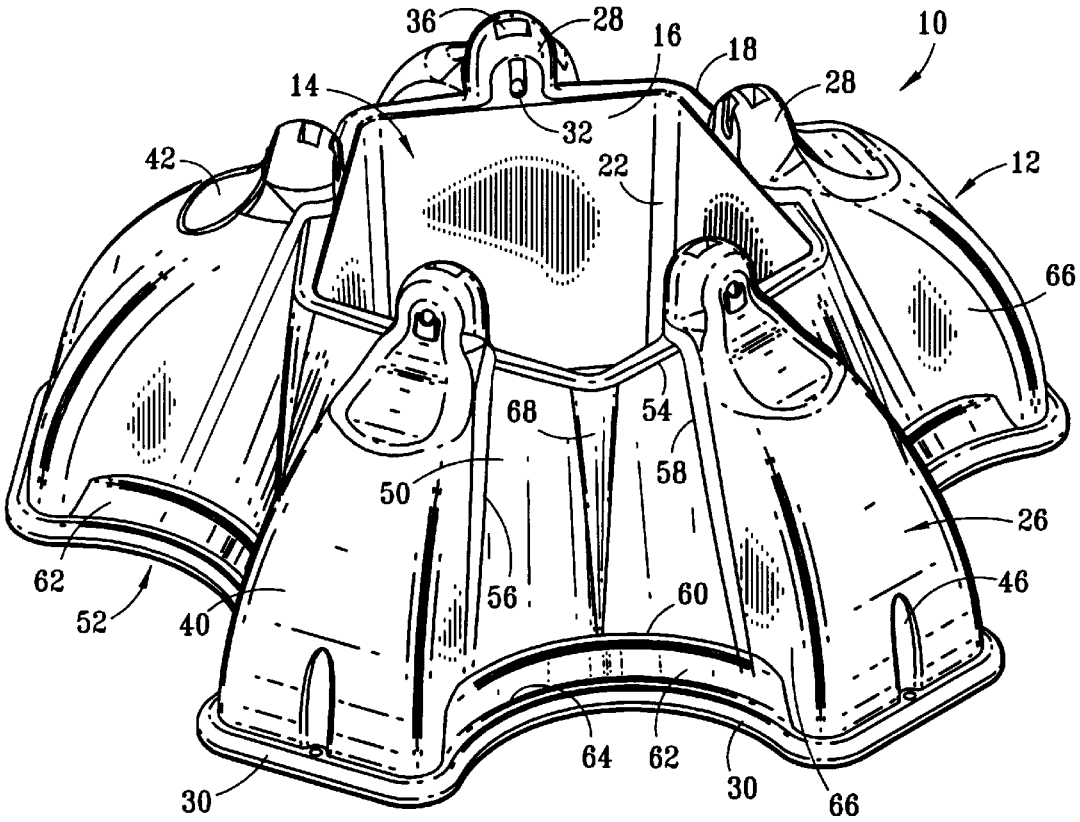
FIG. 3 is a top perspective view of the tree stand of FIGS. 1 and 2.

Referring to FIGS. 1–3, tree stand 10 preferably comprises a unitarily molded plastic body 12 having a pentagonally shaped reservoir 14. As used herein, "pentagonally shaped" means that the reservoir has five side walls 16 and a substantially pentagonal cross-section between top rim 18 and bottom 20. Side walls 16 are preferably substantially smooth and taper slightly inward as they extend downwardly from top rim 18 to bottom 20. Corners 22 between adjacent side walls are desirably made with a radius to facilitate molding and reduce stress concentrations in the molded product. Tree stand 10 is preferably made of an injection-moldable polymeric resin. While the subject resin can be either foamed or unformed, the resultant stand will desirably have sufficient strength and rigidity to support a decorative tree, either artificial or natural, inside the stand with the aid of threaded adjustment bolts 34 (visible in FIG. 4). The large pentagonal bottom 20 of reservoir 14 allows tree stand 10 to be used with trees having large diameter trunks, and corners 22 allow room for portions of irregularly shaped trunks to be accommodated inside pentagonal reservoir 14.

A plurality of buttresses 26 are desirably spaced around pentagonal reservoir 14, with one such buttress being centered on and oriented in generally perpendicular relation to each side wall 16 of pentagonal reservoir 14. Each buttress 26 is preferably topped by a bolt receptacle 28 that extends above the level of top rim 18 of reservoir 14. Buttresses 26 extend radially outward from reservoir 14 and curve downwardly to a peripherally extending base flange 30. Each bolt receptacle 28 preferably comprises a radially extending aperture 32 adapted to receive a threaded adjustment bolt 34 (FIG. 4) therethrough, and a vertically oriented slot 36 into which a threaded nut can be dropped for threaded engagement with the bolt. Aperture 32 can comprise two aligned holes disposed in the inside and outside walls, respectively, of bolt receptacles 28. Apertures 32 can also be aligned so that an adjustment bolt 34 inserted through the aperture is slightly inclined. Alternatively, other similarly effective means can likewise be provided for receiving adjustment bolts 34. Such means can include a molded boss through which a bolt is self-threaded, a thin metal clip dropped or inserted into bolt receptacle 28 that is threadable onto adjustment bolt 34, or the like. The use of five buttresses 26 and five bolt receptacles 28 evenly spaced around reservoir 14 provides excellent support to tree stand 10 and a tree mounted in it. The inwardly facing surface 38 of each bolt receptacle 28 is preferably substantially continuous with side wall 16 of reservoir 14. Corners 22 at top rim 18 of reservoir 14 extend outwardly past an imaginary line extending between the midpoints of bolt receptacles 28 of adjacent side walls 16.

Figure 4:
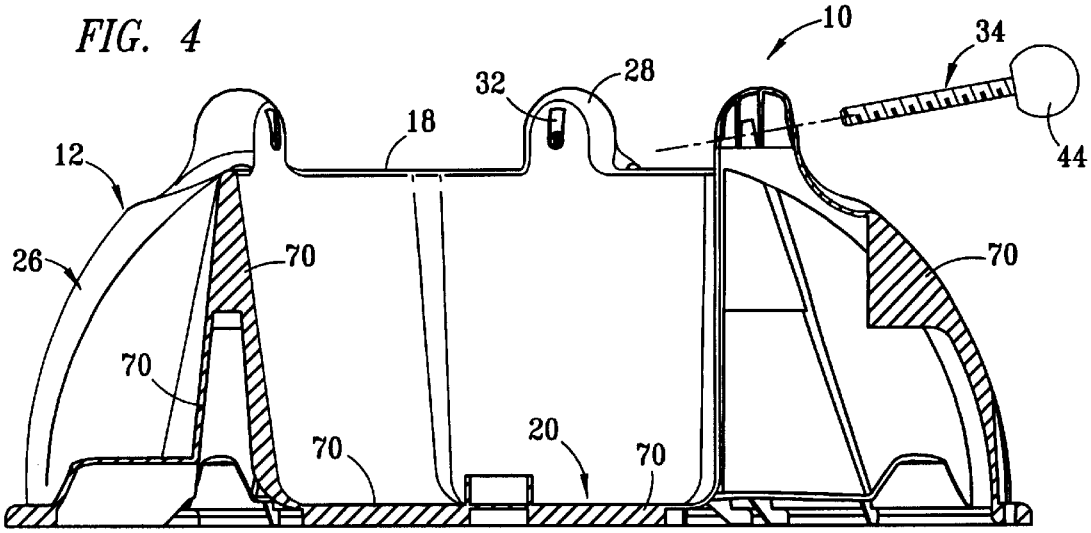
FIG. 4 is a cross-sectional elevation view taken along line 4—4 of FIG. 1.

Near the top of the outwardly facing surface 40 of each buttress 26, a concave recess 42 is desirably disposed adjacent to each bolt receptacle 28 to provide relief for the head 44 of an adjustment bolt such as bolt 34 seen in FIG. 4. According to one particularly preferred embodiment of the invention, a vertically oriented concave recess 46 is also provided near the bottom of outwardly facing surface 40 of each buttress 26 adjacent to base flange 30 and aligned with an aperture 48 through base flange 30. Apertures 48 are provided to permit the insertion of screws or other fasteners for use in securing tree stand 10 to an underlying surface. If desired, apertures can instead be provided at spaced-apart points along base flange 30 that are not aligned with buttresses 26.

Disposed between buttresses 26 are outwardly facing sidewall sections 50 of tree stand 10 that extend downwardly and outwardly from top rim 18 of reservoir 14 to inwardly curving arcs 52 of base flange 30. According to a preferred embodiment of the invention, sections 50 have a complex three-dimensional geometry, with substantially linear top and side edges 54, 56, 58, and an arcuate bottom edge 60. Upwardly directed retaining walls 62 are preferably disposed along arcs 52, with their bottom edges 64 supported by base flange 30 and their side edges abutting sides 66 of buttresses 26. Corners 22 of pentagonal reservoir 14 cause sidewall sections 50 to project outwardly near the top, said projections 68 tapering into the outwardly inclined sections 50 near the point of attachment to base flange 30.

Figure 5:
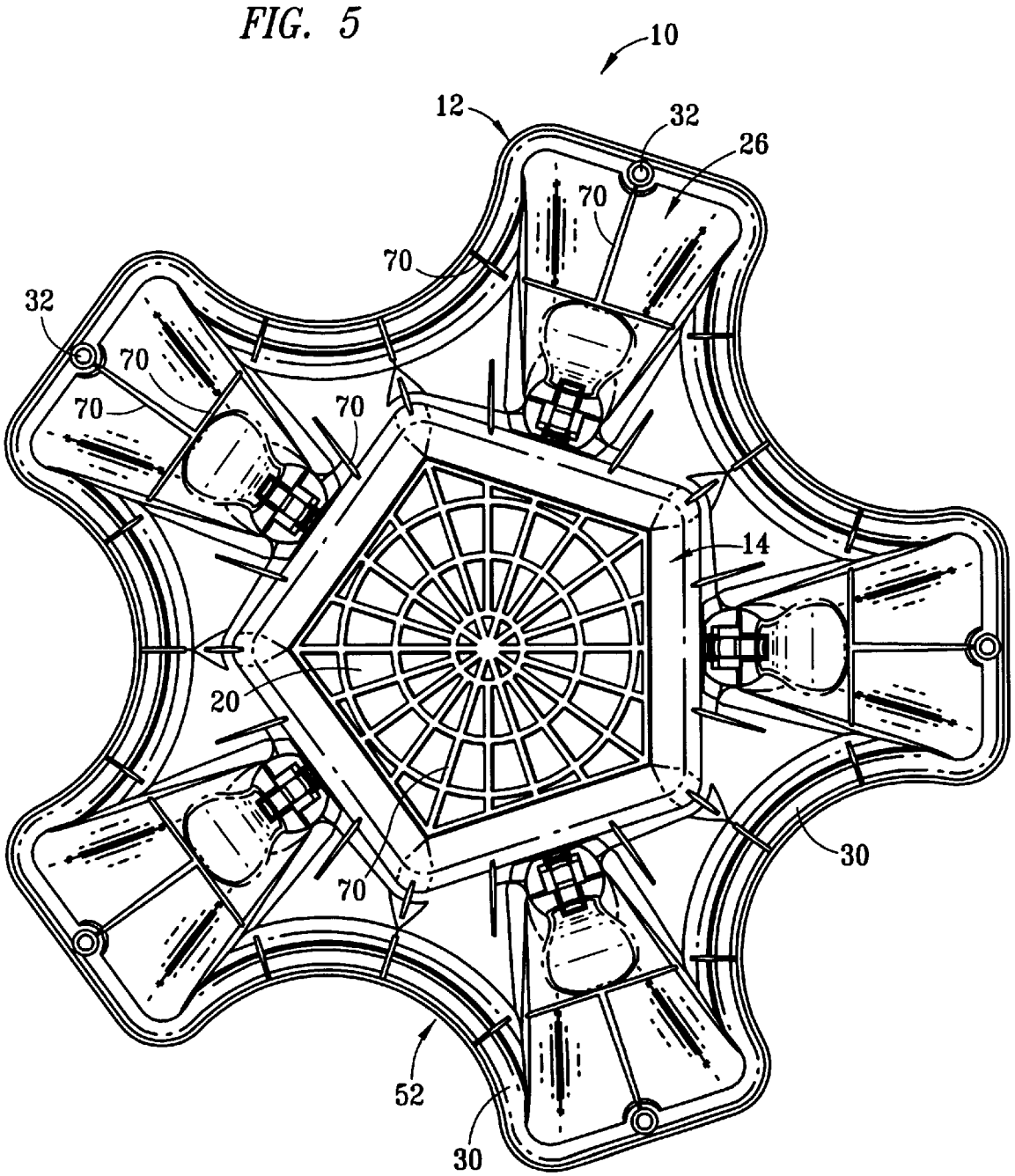
FIG. 5 is a bottom plan view of the tree stand of FIGS. 1–3.

Referring to FIGS. 4 and 5, a plurality of ribs 70 are unitarily molded into the underside of tree stand 10 to contribute strength and rigidity to the stand, particularly when loaded with the weight of a tree supported inside pentagonal reservoir 14.

Although the tree stand of the invention is disclosed herein in relation to its preferred embodiment, other alterations and modifications of the subject invention will become apparent to those of ordinary skill in the art upon reading this disclosure, and it is intended by the inventors that the scope of the invention be limited only by the broadest interpretation of the appended claims to which the inventors are legally entitled.

What is claimed is:

1. A tree stand comprising a unitarily molded plastic body having a reservoir with a pentagonal cross-section, a top rim, side walls having a smooth downward and inward taper from the top rim to a bottom; a downwardly curved buttress extending radially outward from each side wall of the reservoir to peripherally extending base flange defining inwardly curving arcs between adjacent buttresses; and a bolt receptacle elevated above the top rim at the top of each buttress.

2. The tree stand of claim 1, further comprising an upwardly directed retaining wall disposed along said arc between the buttresses of adjacent side walls.

3. The tree stand of claim 1 wherein each bolt receptacle has an inwardly facing surface that is substantially continuous with an inwardly facing side wall surface of the pentagonal reservoir.

4. The tree stand of claim 1, further comprising a concave recess molded into the top of each buttress radially outward of the bolt receptacle.

5. The tree stand of claim 1, further comprising a plurality of apertures spaced apart along the flange.

6. The tree stand of claim 1, further comprising a concave recess at the base of each buttress, said recess being vertically aligned with an aperture through the flange.

7. The tree stand of claim 1 wherein a top corner of the pentagonal reservoir is disposed between and outwardly of the bolt receptacles on two adjacent side walls.

8. The tree stand of claim 1, further comprising a plurality of unitarily molded reinforcing ribs.

* * * * *